United States Patent [19]

Abendroth et al.

[11] 4,446,814

[45] May 8, 1984

[54] DEVICE FOR APPLYING A FLUID, IN PARTICULAR LACQUERS ON PRINTED SHEETS OR CONTINUOUS WEBS

[75] Inventors: Paul Abendroth; Janko Despot, both of Offenbach am Main, Fed. Rep. of Germany

[73] Assignee: M.A.N. - Roland, Fed. Rep. of Germany

[21] Appl. No.: 347,144

[22] Filed: Feb. 9, 1982

[30] Foreign Application Priority Data

Feb. 12, 1981 [DE] Fed. Rep. of Germany ..... 3105020

[51] Int. Cl.[3] ..... B05C 1/00

[52] U.S. Cl. ..... 118/694; 118/46; 118/262

[58] Field of Search ..... 118/694, 259, 665, 262, 118/46, 210; 101/363

[56] References Cited

U.S. PATENT DOCUMENTS

| | | | |
|---|---|---|---|
| 2,406,470 | 4/1944 | Maxim et al. | 118/694 |
| 3,115,433 | 12/1963 | Eolkin et al. | 101/364 X |
| 3,339,485 | 9/1967 | Rytterholm | 118/694 X |
| 3,635,191 | 1/1972 | Gibson | 118/694 |
| 3,931,791 | 1/1976 | Preuss et al. | 118/262 X |
| 4,251,566 | 2/1981 | Gingerich | 118/665 X |

*Primary Examiner*—John P. McIntosh
*Attorney, Agent, or Firm*—Leydig, Voit, Osann, Mayer & Holt, Ltd.

[57] ABSTRACT

A device for application of lacquer or the like to a sheet in a printing press. The lacquer is applied by an applicator cylinder having an associated applicator roller. Lacquer is fed from a fountain having a fountain roller which is slowly driven, the lacquer being transferred from the fountain roller to the applicator roller either directly or through intermediate rollers to form a nip in which the lacquer tends to build up. The amount of lacquer transferred by the fountain roller per unit time is determined by a metering roller which engages the fountain roller. A sensing device located at the nip senses the level of lacquer buildup and produces an output signal upon departure of the building from an optimum level. In one embodiment of the invention the output signal is utilized to bring about a corrective adjustment in the position of the metering roller so that the buildup at the nip tends to be restored to optimum level. In another embodiment the output signal sounds an alarm and, if desired, brings the press to a stop so that the situation can be corrected before the applicator cylinder runs dry.

2 Claims, 3 Drawing Figures

DEVICE FOR APPLYING A FLUID, IN PARTICULAR LACQUERS ON PRINTED SHEETS OR CONTINUOUS WEBS

A printing press, in addition to performing its printing function, is often utilized to apply lacquer or other coating material to the sheet. For this purpose an applicator cylinder, having a film of lacquer thereon, engages the face of the sheet as it it supported upon an impression cylinder. For the purpose of furnishing the applicator cylinder with lacquer a "scoop" or fountain roller is partially immersed in a body of lacquer contained in a tray or trough, with the rate of feed being controlled by a metering roller. An applicator roller is interposed between the fountain roller and the applicator cylinder for transfer of the lacquer from the fountain to the cylinder.

The rate of feed of the lacquer must be carefully monitored by the pressman to prevent the applicator cylinder from running dry. Should this occur, the printed material would fail to meet specifications resulting in a loss to the printer.

It is, accordingly, an object of the present invention to provide means including a sensor for monitoring lacquer buildup in a nip in the supply path and for creating an output signal when the buildup departs from an optimum level. It is a related object to provide means responsive to the variation in buildup to produce an output signal which, at the option of the user, (a) sounds an alarm, (b) shuts down the press, or (c) brings about an automatic corrective variation in the rate of feed. It is a more general object of the invention to utilize, as an indicator of feed, the buildup of lacquer or other liquid which occurs at the nip of a pair of counter-rotating rollers in the feed system.

It is another object of the present invention to provide means for monitoring the flow of lacquer or other liquid in a printing press which operates reliably and which is highly economical to install and maintain.

Other objects and advantages of the invention will become apparent upon reading the attached detail description and upon reference to the drawings, in which.

Figure 2:
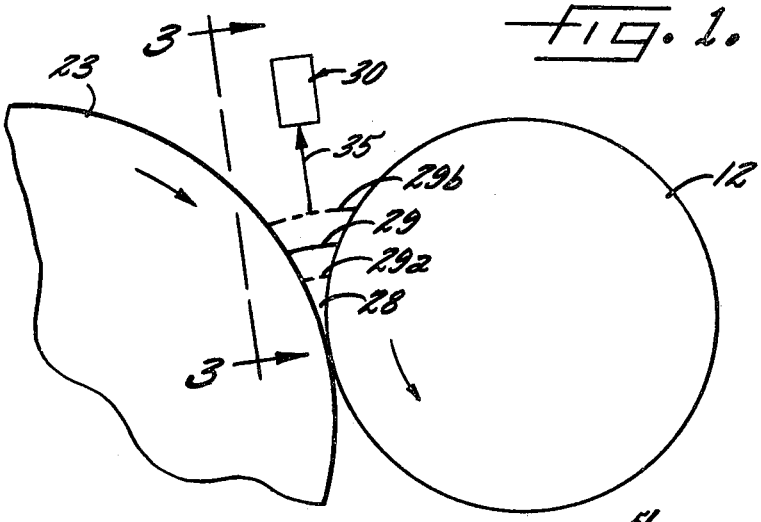
FIG. 2 is a fragmentary elevation showing the buildup on an enlarged scale.
Figure 3:
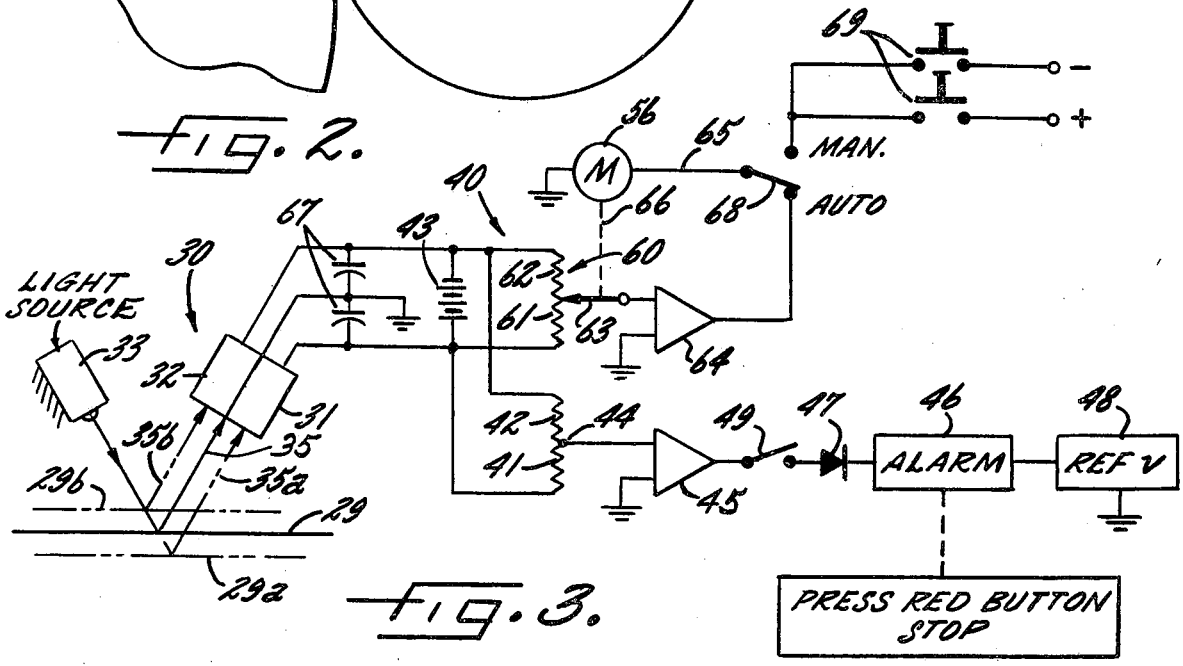

FIG. 3, viewed along line 3—3 in FIG. 2, shows a simplified system for detecting the level of buildup and for causing a departure from optimum to (a) sound an alarm, (b) stop the press drive or (c) bring about a corrective change in the rate of feed.

While the invention has been described in connection with certain perferred embodiments, it will be understood that we do not intend to be limited to the embodiments shown but intend, on the contrary, to cover the various alternative forms of the invention included within the spirit and scope of the appended claims.

Figure 1:
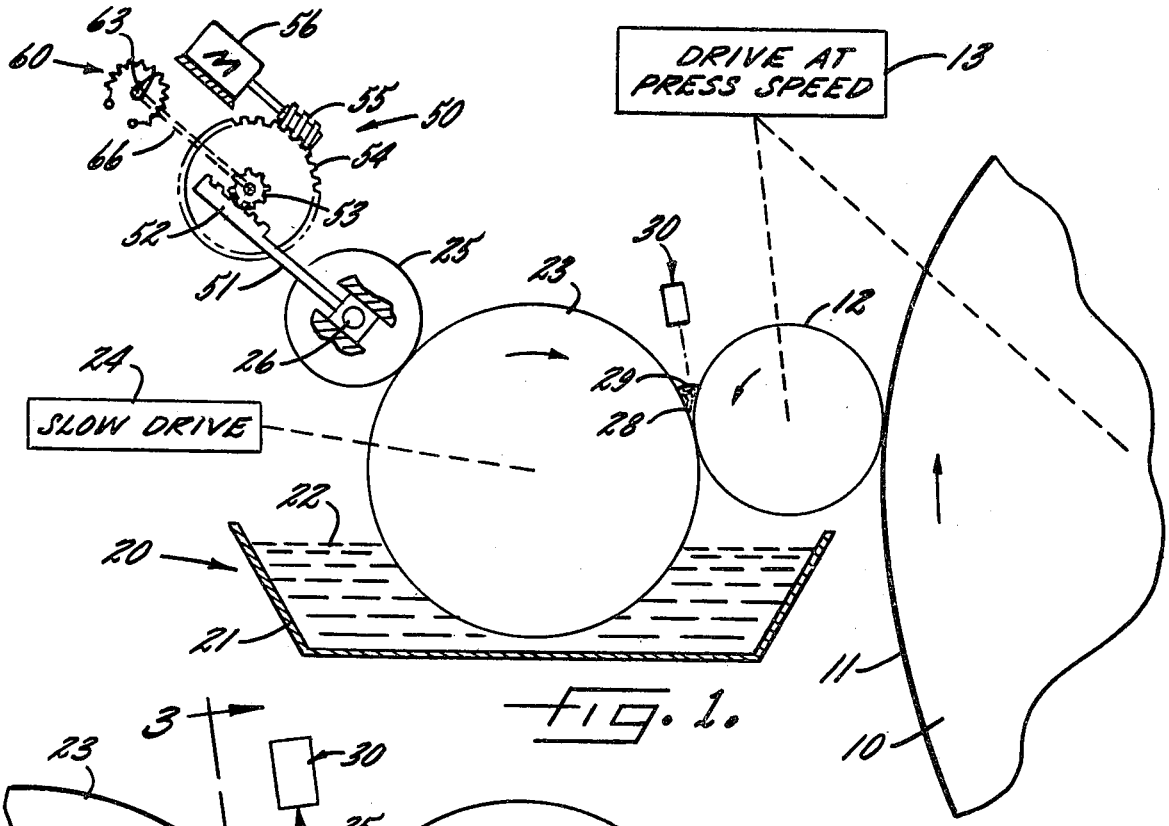
FIG. 1 is a diagram, in elevation, of a lacquer feeding arrangement in a printing press with provision for monitoring the level in a nip and for producing an output signal in accordance with the level of buildup.

Turning now to FIG. 1 there is shown an applicator cylinder 10 having a surface 11 which carries a film of lacquer for application to a sheet mounted upon a cooperating impression cylinder (not shown). In rolling engagement with the applicator cylinder is an applicator roller 12, the surfaces of the roller and cylinder being operated at "press speed" by a drive 13.

For the purpose of furnishing lacquer to the applicator cylinder, a fountain 20 is provided having a tray or trough 21 containing a body of the lacquer 22. Partially submerged in the lacquer is a fountain roller 23 which is rotated at slow speed by a drive 24. On the "emerging" or left-hand side of the fountain roller 23 is a metering roller 25 having a shaft 26 which is journalled in a bearing 27. Applicator roller 12 and fountain roller 23, rotating in opposite directions, meet at a nip 28. There tends to accumulate, in the nip, a buildup of lacquer indicated at 29, which buildup has an optimum level, indicating an adequate rate of feed, during normal operation. When the buildup exceeds the optimum condition "runover" tends to occur, and when the buildup is less than optimum there is risk that the applicator cylinder 11 will run dry so that the sheets which are produced will be uncoated and therefore unsalable.

In accordance with the present invention a sensing device is located opposite the nip 28 for constantly monitoring the level of buildup and for producing an output signal, utilized by the pressman, when the buildup departs from optimum. The sensing device, indicated at 30, may take various forms without departing from the invention. For example, the sensing device may be of the optical type as illustrated in FIG. 3 consisting of adjacent photocells 31, 32 illuminated by a light source 33. The light source produces a beam 34 which is specularly reflected from the surface of the buildup along path 35. When the level of buildup 29 is optimum, the light reflected into the photocells 31, 32 will be equal and no output signal will be produced. The level of buildup may fall to the level **29*a* which causes the reflective path to switch to position 35*a* which favors the photocell 31. Such condition produces an output signal for the sounding of an alarm or the like. Alternatively, the buildup may rise to the level 29*b* resulting in a reflection path 35*b* which favors the photocell 32**. This also produces an output signal which results in corrective action being taken.

In carrying out the invention a bridge circuit is provided for responding to unbalance between the two photocells and for producing an output signal in accordance therewith. This bridge circuit, indicated at 40, has the photocells 31, 32 in its first two legs and resistors 41, 42 in third and fourth legs, respectively. The bridge is energized by a battery 43. Thus, under conditions of unbalance an output signal exists at output terminal 44. The output voltage is amplified by an amplifier 45, the output of which energizes an alarm device 46. An interposed diode 47 ensures that the alarm is sounded only in response to a falling level. The point of triggering of the alarm is determined by including, in series, an adjustable source of reference voltage 48. The alarm circuit is turned on by a switch 49.

In operation, and with the bridge initially balanced, the level is at 29 and there is a complete absence of output signal. However, if for any reason the level at the nip should fall, say to the level **29*a*, the photocell 31 is favored as compared to the photocell 32 resulting in an output signal at output terminal 44 which, amplified by amplifier 45 and with favorable polarization at diode 47, the alarm 46 sounds alerting the pressman to check both the rate of feed in the system and the level of the body of lacquer in the tray 21**.

If desired, the alarm device 46 may be coupled to the dropout circuit of the press drive 13, as shown in FIG. 3, in such a way that the alarm condition is effective to trigger a "red button stop", bringing the press quickly to a halt and signifying that corrective action should be urgently taken.

In accordance with one of the aspects of the present invention the output signal from the bridge circuit 40 may be utilized to bring about a corrective change in the rate of feeding of the lacquer by the fountain roller 23. This is brought about by an electro-mechanical servo system 50, the mechanical portion of which is set forth in FIG. 1. Thus, the bearing 27 which supports the shaft of the metering roller 25 is slidably mounted in ways formed in the frame of the machine and positioned by a plunger 51. The plunger 51 is connected to a rack 52 which is driven by a pinion 53 coupled to a gear 54. The latter is rotatable by a worm 55 driven by a reversable motor 56. All that need be said about the motor is that it is capable of driving in opposite directions depending on the polarity of the control signal.

To produce an output signal the bridge 40 is terminated in a potentiometer 60 having legs 61, 62 and a wiper 63. The wiper is connected to the input of an amplifier 64 having an output lead 65 which drives the motor 56. The mechanical output of the motor is coupled by a connection 66 (see also FIG. 1) to the wiper 63 of the potentiometer. Capacitors 67 respectively connected across the photocells 31, 32 have an averaging effect and make the system nonresponsive to transient changes in level and, more particularly, to transient departures from the horizontal.

The servo system is turned on by a switch 68 which is capable, also, of switching push-buttons 69 into the circuit for manual control.

It will be assumed that initially the buildup is horizontal and at the level indicated at 29. It will further be assumed that the bridge, under such conditions, is balanced so that the motor 56 is de-energized. Upon a drop in the level of buildup from 29 to 29*a*, the reflected beam switches to position 35*a* causing more of the reflected light to enter photocell 31 than enters photocell 32. This unbalances the bridge causing an output signal to exist at the bridge terminal 63, which signal is fed to the amplifier 64. The amplified signal is applied, by line 65, to the motor 56 causing the motor to rotate in the direction which produces backing off of the plunger 51 thereby creating additional clearance between the fountain roller 23 and the metering roller 25 allowing lacquer to be transported at a greater rate to the nip 28. At the same time the motor, through connection 66, causes movement of the slider 63 on potentiometer 60 to rebalance the bridge circuit so that the signal fed through the amplifier 64 to the motor 56 is reduced to zero, turning off the motor.

The increased rate of flow of the lacquer causes the buildup to be restored from the low level 29*a* to the optimum level 29. Any tendency of the level to exceed the level 29, causing a rise in the level of buildup to the level 29*b*, results in a switch of the reflected beam to the path 35*b* which causes more light to be transmitted to photocell 32 than is transmitted to photocell 31. This results in an output signal at output terminal 63 of the bridge which is opposite to that previously produced and which, amplified by the amplifier 64, causes the motor 56 to rotate in the opposite direction, that it, in a direction to slightly close down the metering roller 25 reducing the flow of lacquer to the nip 28 and, simultaneously, through connection 66, rebalancing the bridge so that the level of buildup does not substantially exceed the level 29. This constitutes a "hunting" type of control in which the level of buildup swings slightly above and slightly below the optimum level 29 so that the flow of lacquer to the applicator roller and applicator cylinder is, on the average, at an optimum rate.

While the invention has been described in connection with a sensor 30 which works on an optical, or reflective, principle, it will be apparent to one skilled in the art that the invention is not limited thereto and that other sensors 30, arranged opposite the nip 28 for response thereto and capable of producing an output signal which varies in accordance with a departure in buildup from the optimum level, may be substituted without departing from the present invention.

In the arrangement described it is preferable for the fountain, or scoop, roller 23 and the applicator cylinder 11 to be hard surfaced while the applicator roller 12 and metering roller 25 are resiliently surfaced.

Although the invention has been described in connection with a highly simplified arrangement in which there is direct transfer of lacquer from the fountain, or scoop, roller 23 to the counter-rotating applicator roller 12, to produce the buildup 29, it will be understood that the invention is not limited to such simplified form and, if desired, additional roller may be interposed between the fountain roller and applicator roller and driven at a surface speed corresponding to one of them, for creation of a nip having a region of buildup which is monitored by a sensing device 30 as described.

The term "signalling means" as used herein refers to any means capable of attracting the attention of the pressman or for bringing about a corrective change in the rate of feed.

We claim:

1. In a printing press the combination comprising an applicator cylinder for receiving a film of lacquer from an associated counterrotating applicator roller, means for driving the cylinder and applicator roller at press speed, a fountain supplying the lacquer and having a fountain roller partially immersed in a reservoir of lacquer disposed below said fountain roller, means for driving the fountain roller so that it picks up a coating of lacquer from said reservoir, said fountain roller engaging the applicator roller so that some of the lacquer is transferred from the fountain roller to the applicator roller, a metering roller engaging the fountain roller, means for adjusting the transaxial spacing between the metering roller and the fountain roller so that a film of regulated thickness is applied to and transferred by the applicator roller, said fountain roller driving means being operable to drive said fountain roller in a counterrotative direction with respect to the applicator roller with the contacting applicator roller and cylinder surfaces being rotated upwardly at the nip between the applicator roller and the cylinder so that there is no significant buildup of lacquer at the nip between the applicator roller and the cylinder and with the contacting fountain roller and applicator roller surfaces being rotated downward at the nip between the fountain roller and the applicator roller so that the lacquer tends to buildup at the nip between the fountain roller and the applicator roller, the engagement of the fountain roller and the applicator roller causing a desired thickness of lacquer to be transferred to the cylinder when the buildup of lacquer is at an optimum level in the nip between the fountain roller and applicator roller, means including a sensing device located at the nip between the fountain roller and applicator roller for sensing said buildup of lacquer and for producing an output signal upon departure of the buildup from an optimum level, and means responsive to an input signal from the sensing device for acting upon the adjusting means to bring about a corrective adjustment in the position of the metering roller with respect to the fountain roller so that said lacquer buildup in the nip tends to be restored to the optimum level.

2. The combination as claimed in claim 1 further comprising means responsive to the sensing device for emitting a warning signal when the fluid buildup drops substantially below the optimum level.

* * * * *